US005965341A

United States Patent [19]

Merkel et al.

[11] Patent Number: 5,965,341

[45] **Date of Patent: *Oct. 12, 1999**

[54] PHOTOGRAPHIC ELEMENT CONTAINING PARTICULAR COUPLER COMBINATION

[75] Inventors: Paul B. Merkel, Victor; Jerrold N. Poslusny; Ronald E. Leone, both of Rochester, all of N.Y.

[73] Assignee: Eastman Kodak Company, Rochester, N.Y.

[ * ] Notice: This patent is subject to a terminal disclaimer.

[21] Appl. No.: 08/873,530

[22] Filed: Jun. 12, 1997

[51] Int. Cl.[6] ..... G03C 1/08; G03C 7/26; G03C 7/32

[52] U.S. Cl. ..... 430/549; 430/554; 430/555; 430/544; 430/957; 430/505

[58] Field of Search ..... 430/554, 555, 430/544, 957, 505, 549

[56] References Cited

U.S. PATENT DOCUMENTS

| | | | |
|---|---|---|---|
| 4,477,563 | 10/1984 | Ichijima et al. | 430/555 |
| 4,853,319 | 8/1989 | Krishnamurthy et al. | 430/555 |
| 5,250,405 | 10/1993 | Merkel et al. | 430/555 |
| 5,256,528 | 10/1993 | Merkel et al. | 430/555 |
| 5,350,667 | 9/1994 | Singer et al. | 430/555 |
| 5,376,519 | 12/1994 | Merkel et al. | 430/555 |
| 5,411,841 | 5/1995 | Singer et al. | 430/555 |
| 5,447,830 | 9/1995 | Pawlak et al. | 430/555 |
| 5,462,848 | 10/1995 | Merkel et al. | 430/555 |
| 5,605,787 | 2/1997 | Pawlak et al. | 430/555 |
| 5,663,040 | 9/1997 | Bertoldi et al. | 430/555 |
| 5,677,118 | 10/1997 | Spara et al. | 430/555 |

*Primary Examiner*—Geraldine Letscher
*Attorney, Agent, or Firm*—Arthur E. Kluegel

[57] ABSTRACT

The invention provides a photographic element comprising a silver halide emulsion layer sensitive to green light having associated therewith (a) a 1-aryl-3-anilino-4-benzotriazolyl-5-pyrazolone magenta dye-forming DIR coupler of a particular formula, and (b) a 1-aryl-3-anilino-4-phenylthio-5-pyrazolone magenta image dye forming coupler of a particular formula. The element of the invention provides an improved interimage of a green sensitized layer in a multicolor silver halide photographic element.

20 Claims, No Drawings

PHOTOGRAPHIC ELEMENT CONTAINING PARTICULAR COUPLER COMBINATION

FIELD OF THE INVENTION

This invention relates to a photographic element containing a green light sensitive silver halide emulsion layer containing a particular combination of a magenta image dye forming coupler and development inhibitor releasing (DIR) coupler.

BACKGROUND OF THE INVENTION

Many photographic materials, particularly color negative films, contain so-called DIR (development inhibitor releasing) couplers. In addition to forming dye, DIR couplers release inhibitors that can restrain silver development in the layer in which release occurs as well as in other layers of a multilayer photographic material. DIR couplers can help control gamma or contrast, can enhance sharpness or acutance, can reduce granularity and can provide color correction via interlayer interimage effects. There has been a need for more effective magenta dye-forming DIR couplers. Magenta DIR couplers that provide high interimage color correction are particularly desirable for modem color negative films. The combinations of DIR couplers and pyrazolone magenta dye-forming imaging couplers of this invention possess all of these desirable properties, particularly the ability to provide higher interimage than combinations of the prior art.

The DIR couplers of this invention are known as one of many types of DIR couplers and are shown, for example, in U.S. Pat. No. 4,477,563. Deactivating the inhibitor in the processing bath is the object of this patent. This patent suggests a wide range of image coupler and a wide range of DIR couplers, but does not suggest the particular combination of the invention. U.S. Pat. Nos. 5,250,405 and 5,546,848 teach a broad range of couplers and all known DIR couplers but neither teaches nor recognizes the advantages of the invention. The patent is focused on the prevention of continued coupling through the use of a particular solvent for the couplers. U.S. Pat. Nos. 4,853,319; 5,250,405; 5,256,528; 5,350,667; 5,376,519 and 5,462,848 disclose pyrazolone imaging couplers similar to the imaging couplers in the combinations of the current invention. None of these patents shows the advantageous interimage effect of the combination of the invention. As shown hereafter, other DIR couplers taught and used in working examples in the patents give inferior results in interlayer interimage.

It is a problem to be solved to provide a green light sensitive imaging layer which exhibits satisfactory interlayer interimage without sacrificing other properties such as stability, or undue loss of green sensitive layer gamma.

SUMMARY OF THE INVENTION

The invention provides a photographic element comprising a silver halide emulsion layer sensitive to green light having associated therewith (a) a 1-aryl-3-anilino-4-benzotriazolyl-5-pyrazolone magenta dye-forming DIR coupler of formula I, and (b) a 1-aryl-3-anilino-4-phenylthio- 5-pyrazolone magenta image dye forming coupler of formula II:

I

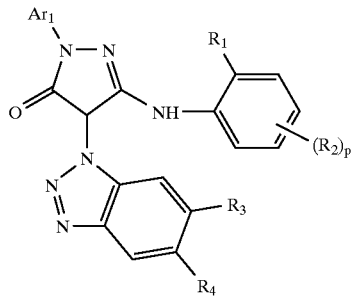

wherein:

$Ar_1$ is an unsubstituted aryl group or an aryl group with one or more substituents individually selected from the group consisting of halogen atoms and alkyl, phenyl, alkoxy, aryloxy, carbonamido, carbamoyl, acyloxy, alkoxycarbonyl, aryloxycarbonyl, sulfonamido, sulfamoyl, sulfonyl, sulfoxyl, sulfonyloxy, and cyano groups;

$R_1$ is a hydrogen or halogen atom or an alkyl or alkoxy group;

each $R_2$ may be in the para position or either meta position relative to the NH group and is individually selected from the group consisting of halogen atoms and alkyl, phenyl, alkoxy, phenoxy, carbonamido, carbamoyl, acyloxy, alkoxycarbonyl, aryloxycarbonyl, sulfonamido, alkylsulfonyl, arylsulfonyl, sulfoxyl, sulfonyloxy, sulfamoyl, alkylthio, arylthio, cyano, and imido groups, and p is 0, 1 or 2;

$R_3$ and $R_4$ are individually selected from hydrogen and halogen atoms, and from alkyl, phenyl, alkoxy, phenoxy, alkoxycarbonyl, aryloxycarbonyl, carbonamido (including alkyl-, aryl-, alkoxy- and aryloxycarbonamido), sulfonamido, carbamoyl and carbamoyloxy groups;

provided that at least one of $R_3$ and $R_4$ is other than hydrogen;

II

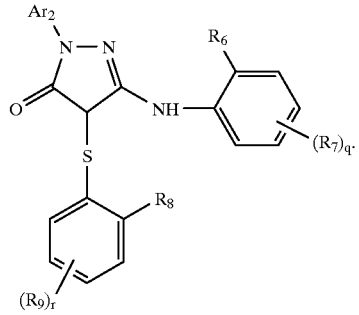

wherein:

$Ar_2$ is an unsubstituted aryl group or an aryl group with one or more substituents individually selected from the group consisting of halogen atoms and alkyl, phenyl, alkoxy, aryloxy, carbonamido, carbamoyl, acyloxy, alkoxycarbonyl, aryloxycarbonyl, sulfonamido, sulfamoyl, sulfonyl, sulfoxyl, sulfonyloxy, and cyano groups;

$R_6$ is a hydrogen or halogen atom or an alkyl or alkoxy group;

each $R_7$ may be in the para position or either meta position relative to the NH group and is individually selected from the group consisting of halogen atoms and alkyl, phenyl, alkoxy, phenoxy, carbonamido, carbamoyl, acyloxy, alkoxycarbonyl, aryloxycarbonyl, sulfonamido, alkylsulfonyl, arylsulfonyl, sulfoxyl, sulfonyloxy, sulfamoyl, alkylthio, arylthio, cyano, and imido groups, and q is 0, 1 or 2;

$R_8$ and $R_9$ are individually selected from the group consisting of hydrogen and halogen atoms and alkyl, alkoxy, phenoxy, carbonamido, carbamoyl, sulfonamido, sulfamoyl, alkylsulfonyl, arylsulfonyl, alkoxycarbonyl, aryloxycarbonyl, acyloxy, sulfoxyl, and sulfonyloxy groups, and r is 0, 1 or 2;

$R_9$ is in the para position or either meta position relative to the sulfur atom; and the total number of carbon atoms in $R_8$ and $R_9$ taken together is at least 4.

The invention also provides a method of forming an image.

The element of the invention provides improved interimage from a green sensitized layer in a multicolor silver halide photographic element.

DETAILED DESCRIPTION OF THE INVENTION

The photographic element of the invention is generally as described in the Summary of the Invention.

In a preferred embodiment the sum of the pi values of $R_3$ and $R_4$ taken together is at least 0.50 but no more than 3.00, and more preferably the sum of the pi values of $R_3$ and $R_4$ taken together is between 1.0 and 2.0. The $Ar_1$ group may be a phenyl group, a pyridyl group, a naphthyl group or a quinoline group, but preferably is a phenyl group. In another preferred embodiment $R_1$ is halogen, such as chlorine or fluorine, or an alkoxy group. In another useful embodiment p is 1, and $R_2$ is an electron-withdrawing group, such as an alkylsulfonyl group or an alkoxycarbonyl group, in the para position relative to the NH group or relative to the $R_1$ group. Similarly, an embodiment wherein q is 1, and $R_7$ is an electron-withdrawing group in the para position relative to the NH group or relative to the $R_6$ group is particularly useful. In another particularly useful embodiment, at least one of $R_3$ and $R_4$ is a readily hydrolyzable group, such as a phenoxycarbonyl group or a $—CO_2CH_2CO_2R_5$ group, wherein $R_5$ is an alkyl or phenyl group, to prevent contamination or seasoning of developer solutions with strong inhibitors. To minimize coupler wandering it is also desirable that the total number of carbon atoms plus halogen atoms in $Ar_1$, $R_1$ and $R_2$ taken together be at least 15, and preferably at least 17. It is also preferred that the total number of carbon atoms in $R_8$ and $R_9$ taken together be at least 5 to minimize interactions with silver involving the arylthio group released on coupling. In another useful embodiment $R_8$ has at least one carbon atom. $R_8$ is desirably an amido or alkyl group.

The use of pi values to describe chemical properties is well established in the literature and is discussed, for example, in "Exploring QSAR, Fundamentals and Applications in Chemistry and Biology", C. Hansch and A. Leo, American Chemical Society, Washington, D.C. 1995. There are numerous published sources for pi values including: "Exploring QSAR, Hydrophobic, Electronic and Steric Constants", C. Hansch, A. Leo and D. Hoekman, American Chemical Society, Washington, D.C., 1995; "Substituent Constants for Correlation Analysis", C. Hansch and A. Leo, John Wiley & Sons, New York, 1979; and A. Leo in "Comprehensive Medicinal Chemistry", edited by C. Hansch, P. G. Sammes, and J. B. Taylor, Permagon Press, New York, 1972. Generally, pi values of substituents increase with increasing hydrophobicity. Pi of hydrogen equals zero.

The alkyl substituents on Ar or comprising $R_1$–$R_9$ may be branched, unbranched or cyclic and may be unsubstituted or substituted. The alkoxy groups on $Ar_1$ or $Ar_2$ or comprising $R_1$–$R_4$ and $R_6$–$R_9$ may be unbranched or branched and may be substituted or unsubstituted. The phenyl groups on Ar or comprising $R_2$–$R_5$ and $R_7$ and the phenoxy groups on $Ar_1$ or $Ar_2$ or comprising $R_2$–$R_4$ and $R_7$–$R_9$ may be unsubstituted or substituted. The alkylthio group comprising $R_2$ and $R_7$ may be unbranched or branched and unsubstituted or substituted. The alkoxycarbonyl, aryloxycarbonyl, carbonamido, carbamoyl, and sulfonamido groups substituting $Ar_1$ or $Ar_2$ or comprising $R_2$–$R_4$ and $R_7$–$R_9$, and the carbamoyloxy groups comprising $R_3$ or $R_4$ may be unsubstituted or further substituted. The acyloxy, sulfamoyl, sulfonyl, sulfoxyl, and sulfonyloxy groups on Ar or comprising $R_2$ and $R_7$–$R_9$ may also be further substituted. Any substituent may be chosen to substitute the Ar substituents or the $R_1$–$R_9$ groups of this invention that does not adversely affect the performance of the pyrazolone DIR/imaging coupler combinations of this invention, as described more fully with respect to substituent groups hereinafter.

Useful coated levels of the magenta dye-forming pyrazolone DIR couplers (I) of this invention range from about 0.005 to about 0.40 g/sq m, or more typically from 0.01 to 0.20 g/sq m. Useful coated levels of the magenta dye-forming pyrazolone imaging couplers (II) of this invention range from about 0.02 to about 2.00 g/sq m, or more typically from 0.05 to 1.00 g/sq m.

The couplers of this invention are usually utilized by dissolving them in high-boiling coupler solvents and then dispersing the organic coupler plus coupler solvent mixtures as small particles in aqueous solutions of gelatin and surfactant (via milling or homogenization). Removable auxiliary organic solvents such as ethyl acetate or cyclohexanone may also be used in the preparation of such dispersions to facilitate the dissolution of the coupler in the organic phase. Coupler solvents useful for the practice of this invention include aryl phosphates (e.g. tritolyl phosphate), alkyl phosphates (e.g. trioctyl phosphate), mixed aryl alkyl phosphates (e.g. diphenyl 2-ethylhexyl phosphate), aryl, alkyl or mixed aryl alkyl phosphonates, phosphine oxides (e.g. trioctylphosphine oxide), esters of aromatic acids (e.g. dibutyl phthalate, octyl benzoate, or benzyl salicylate) esters of aliphatic acids (e.g. acetyl tributyl citrate or dibutyl sebecate), alcohols (e.g. 2-hexyl-1-decanol), phenols (e.g. p-dodecylphenol), sulfoxides (e.g. bis(2-ethylhexyl) sulfoxide), sulfonamides (e.g. N,N-dibutyl-p-toluenesulfonamide) or hydrocarbons (e.g. dodecylbenzene). Additional coupler solvents and auxiliary solvents are noted in Research Disclosure, December 1989, Item 308119, p 993. Useful coupler:coupler solvent weight ratios range from about 1:0.1 to 1:8.0, with 1:0.2 to 1:4.0 being preferred.

The pyrazolone DIR and imaging coupler combinations of this invention may be used together with a variety of other types of couplers in the same layer or in different layers of a multilayer photographic material. The coupler combinations may also be used with a variety of silver halide emulsion types, including thin tabular emulsions. The pyrazolone DIR and imaging coupler combinations of this invention may be particularly useful in color negative films comprising magnetic recording layers. In such films it is desirable to minimize component contributions to Dmin density. The combinations of this invention may help accomplish this by allowing reduced levels of magenta dye-forming yellow-colored masking couplers.

Examples of pyrazolone DIR couplers (I) of this invention include, but are not limited to A1–A24, below:

A1
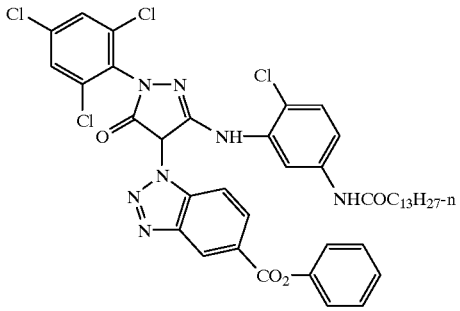
A2
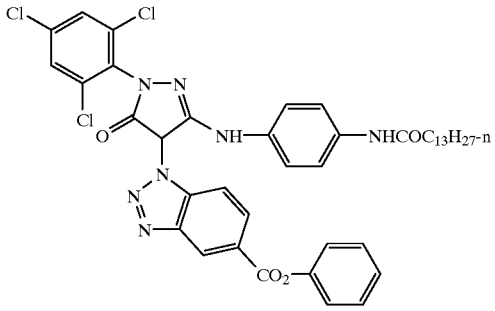
A3
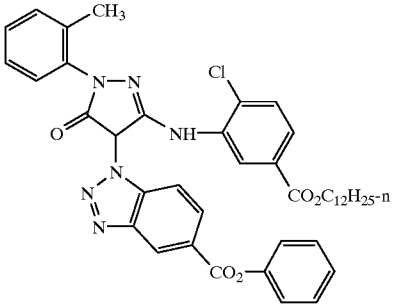
A4
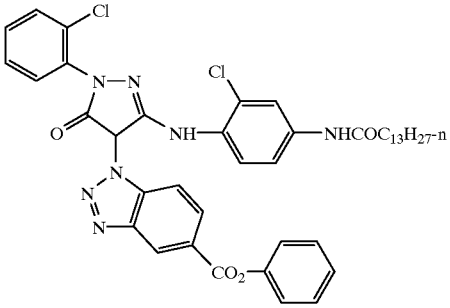
A5
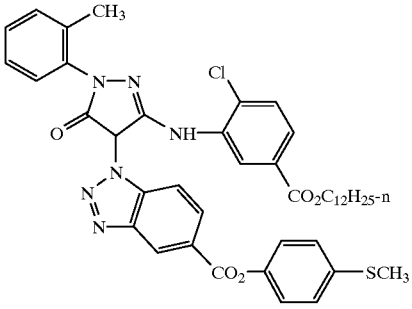
-continued
A6
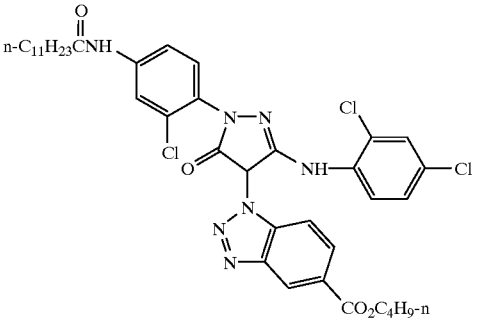
A7
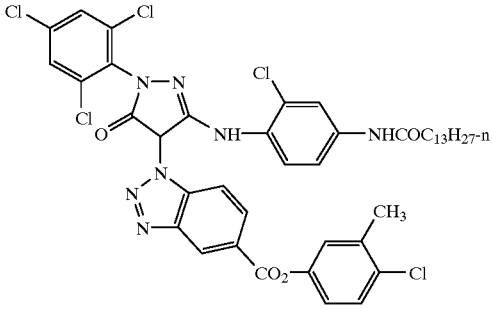
A8
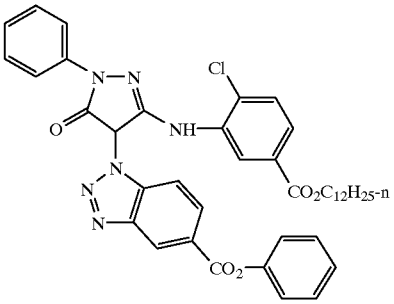
A9
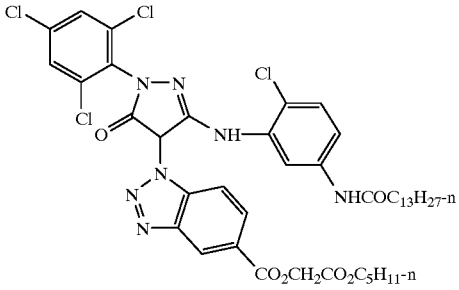
A10
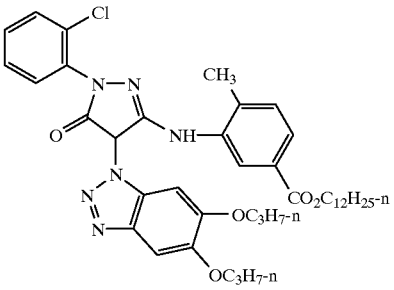

-continued
A11
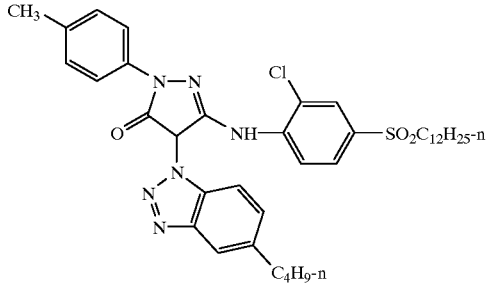
A12
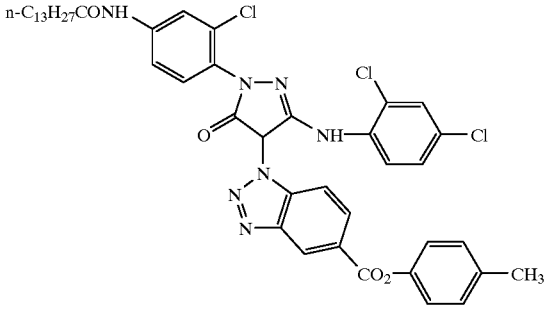
A13
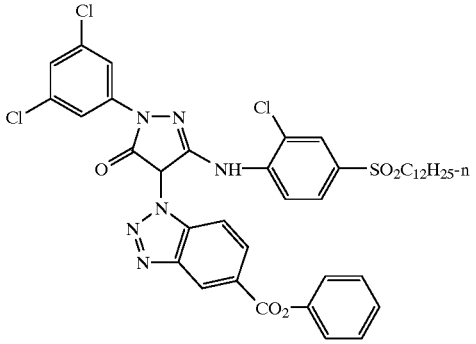
A14
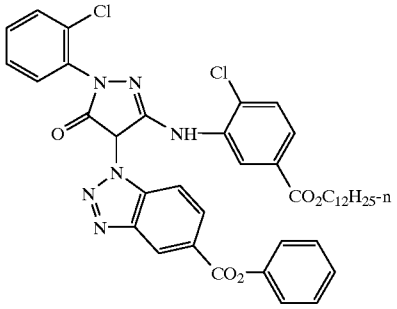
A15
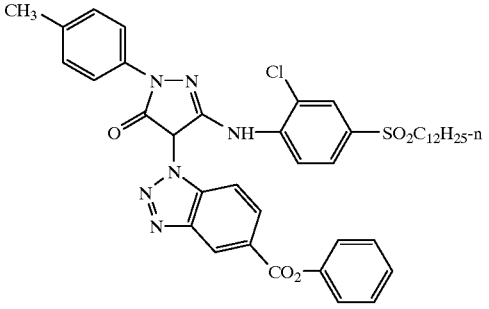
-continued
A16
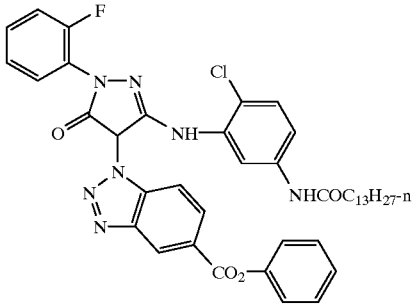
A17
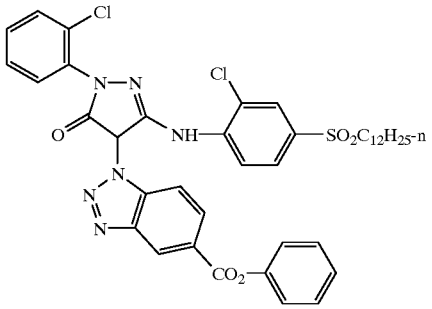
A18
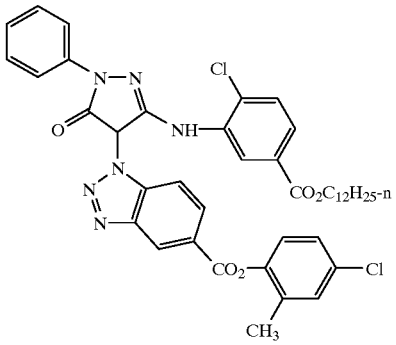
A19
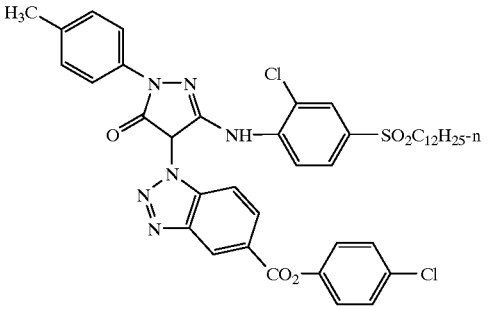

-continued
A20
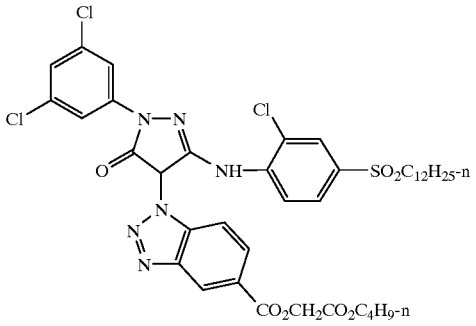
A21
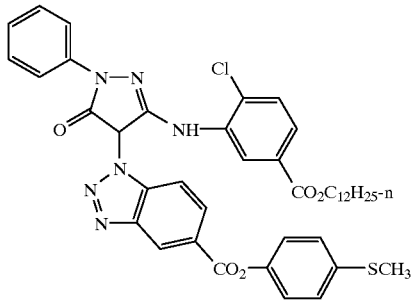
A22
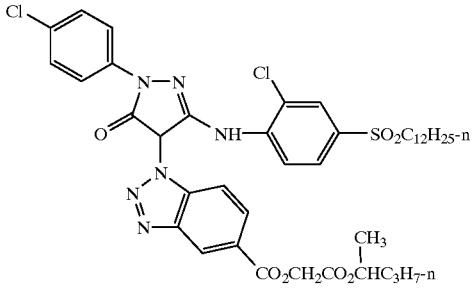
A23
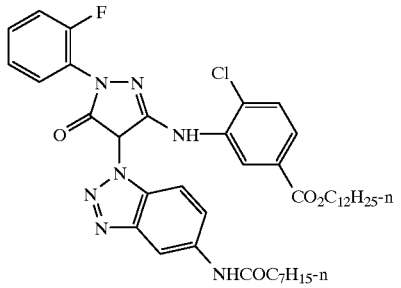
A24
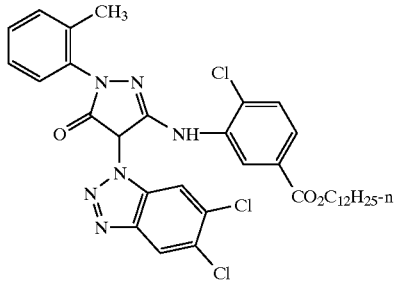
Examples of pyrazolone imaging couplers (II) of this invention include, but are not limited to, B1–B18, below:
B1
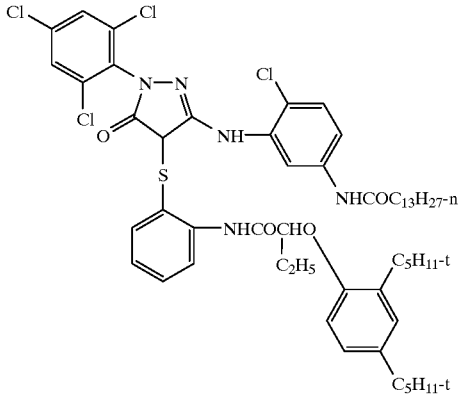
B2
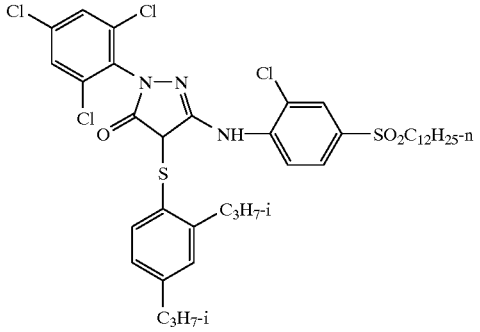
B3
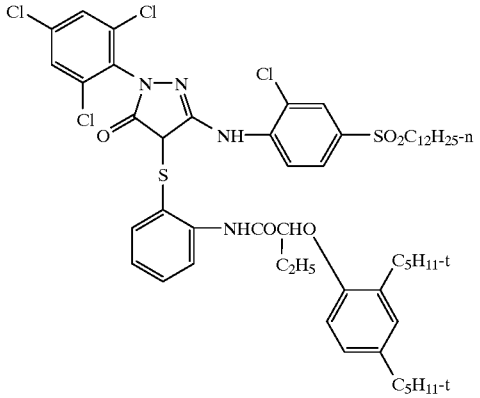
B4
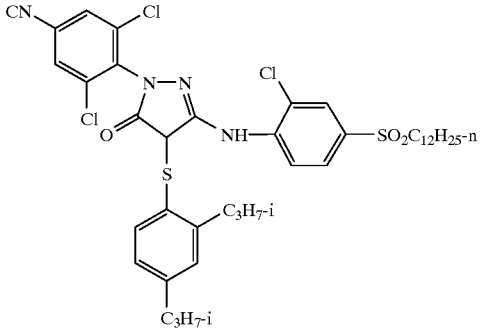

-continued
B5
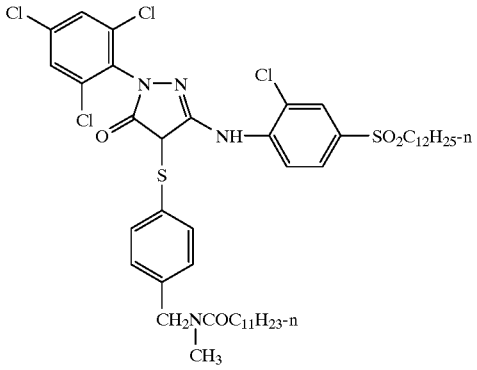
B6
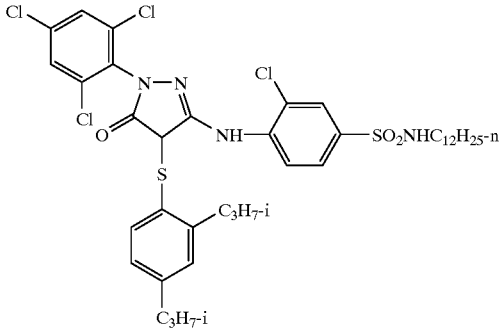
B7
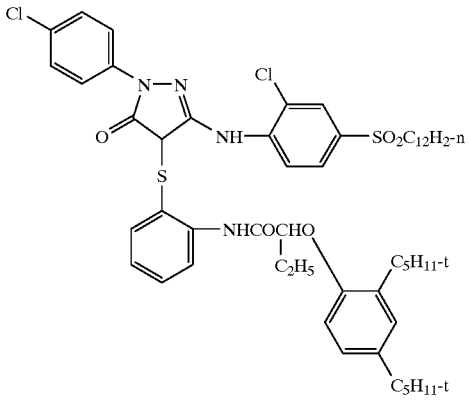
B8
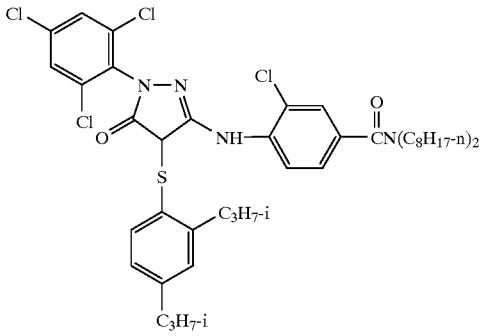
-continued
B9
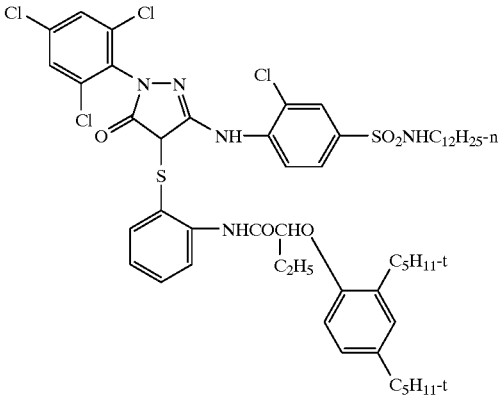
B10
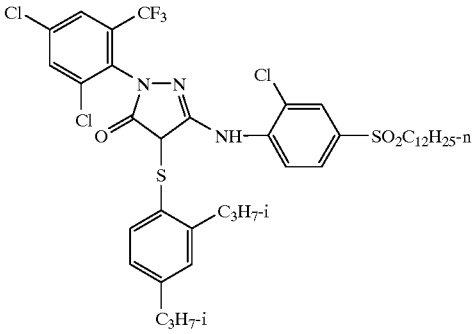
B11
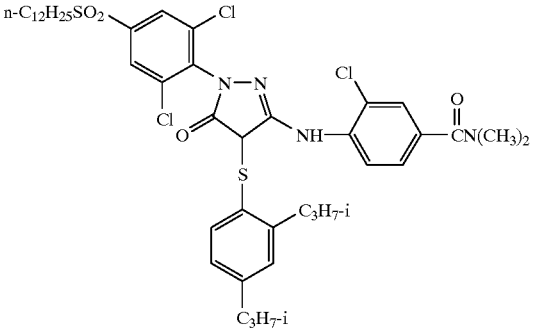
B12
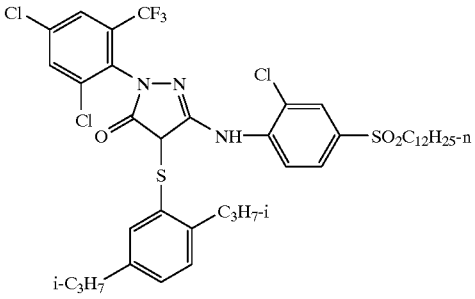

-continued

B13

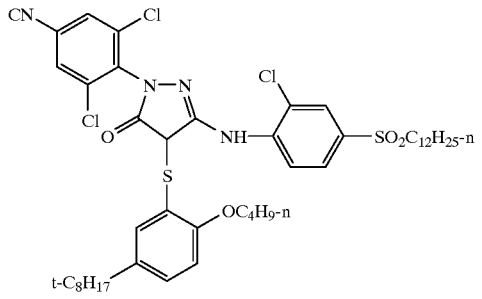

B14

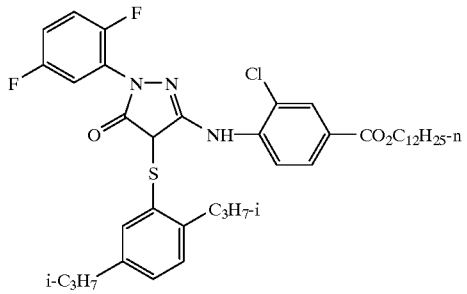

B15

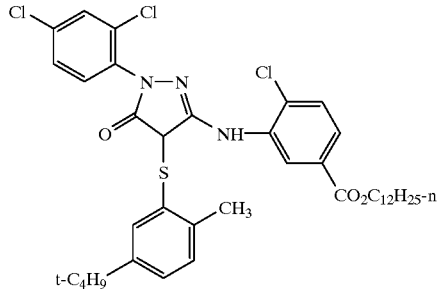

B16

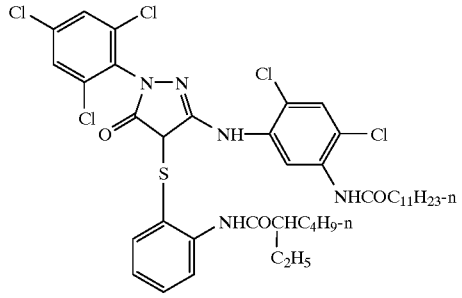

B17

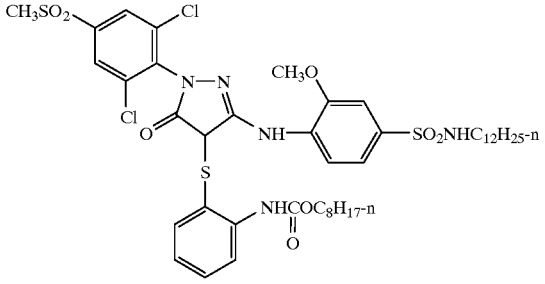

-continued

B18

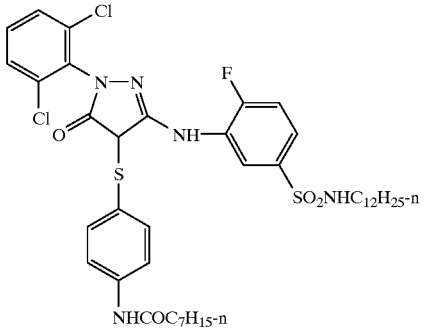

Unless otherwise specifically stated, when a substituent group contains a substitutable hydrogen, it is intended to encompass not only the substituent's unsubstituted form, but also its form further substituted with any group or groups as herein mentioned, so long as the group does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl;

carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure,* Item No. 36544 referenced above, is updated in the September 1996 *Research Disclosure,* Item No. 38957. Certain desirable photographic elements and processing steps, including those useful in conjunction with color reflective prints, are described in *Research Disclosure,* Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat Nos. 2,367,531, 2,423,730, 2,474,293, 2,772,162, 2,895,826, 3,002,836, 3,034,892, 3,041,236, 4,333,999, 4,883,746 and "Farbkuppler-eine Literature Ubersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine Literature Ubersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: UK. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148, 062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

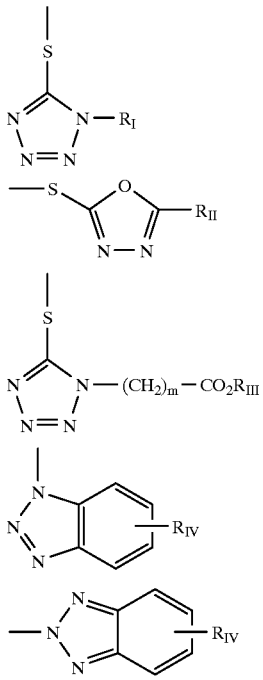

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

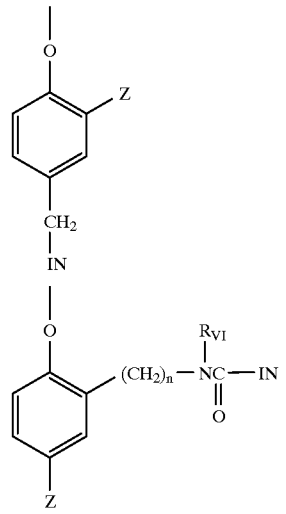

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

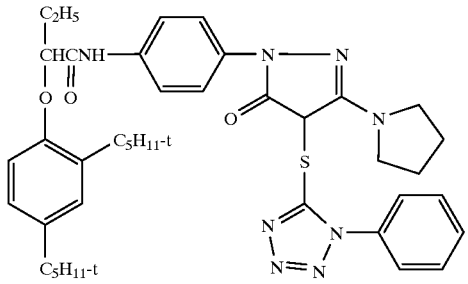

D2

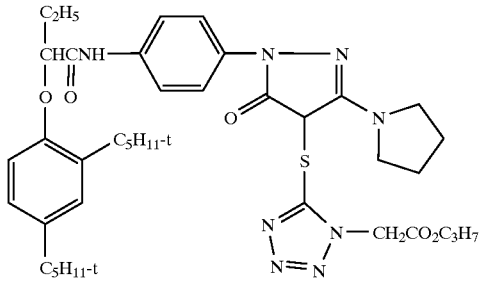

D3

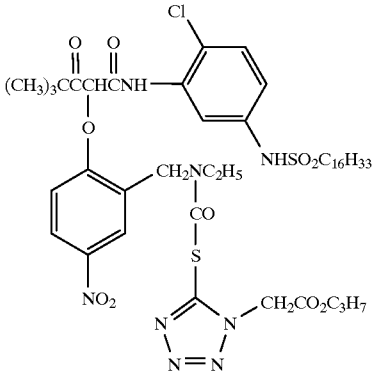

D4

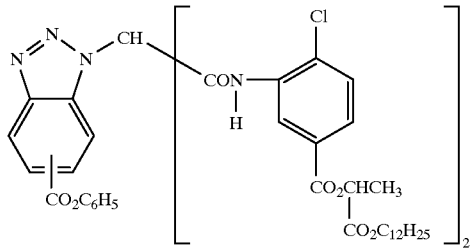

-continued

D5

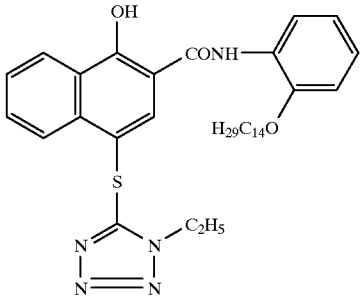

D6

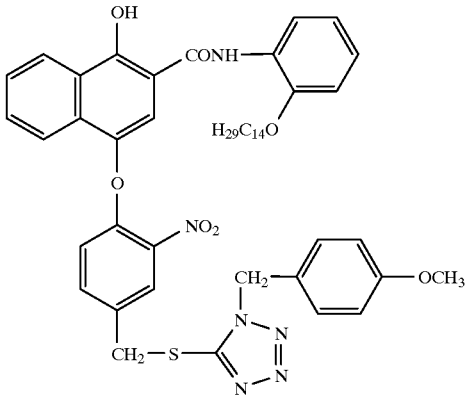

D7

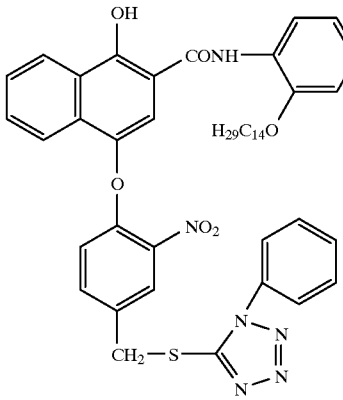

D8

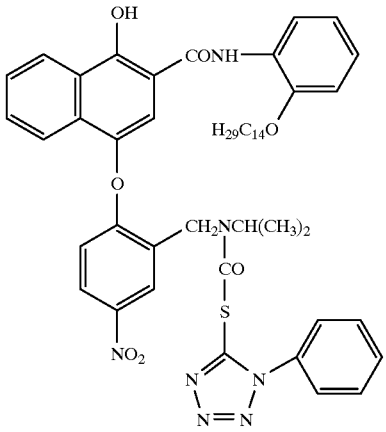

-continued

D9

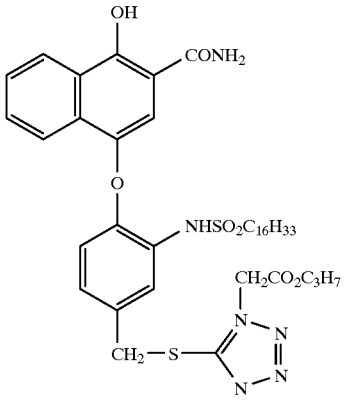

D10

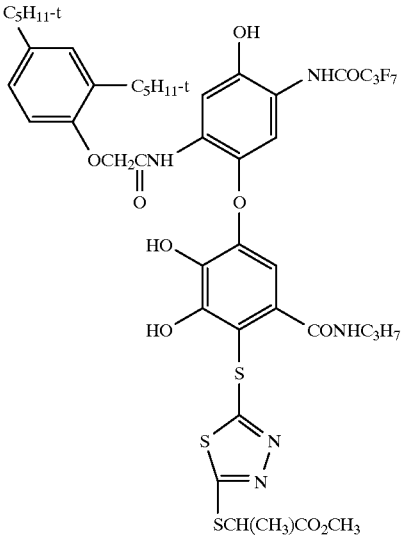

D11

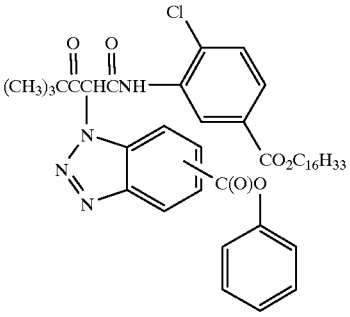

-continued

D12

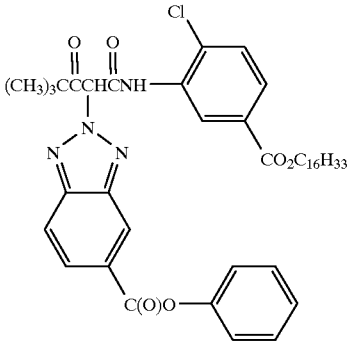

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.07 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions and may be processed, for example, in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

Another type of color negative element is a color print. Such an element is designed to receive an image optically printed from an image capture color negative element. A color print element may be provided on a reflective support for reflective viewing (e.g. a snap shot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The print may then be processed to form a positive reflection image using, for example, the Kodak RA-4 process as described in The British Journal of Photography Annual of 1988, Pp 198–199. Color projection prints may be processed, for example, in accordance with the Kodak ECP-2 process as described in the H-24 Manual. Color print development times are typically 90 seconds or less and desirably 45 or even 30 seconds or less.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process. Alternatively, a direct positive emulsion can be employed to obtain a positive image.

The above emulsions are typically sold with instructions to process using the appropriate method such as the mentioned color negative (Kodak C-41), color print (Kodak RA-4), or reversal (Kodak E-6) process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patent applications, patents and other publications referred to in this specification are incorporated herein by reference.

EXAMPLES

Example 1

Illustration of the interlayer interimage provided by the combination of the DIR and imaging couplers of the invention.

To illustrate the superior silver development inhibition and interimage provided by the pyrazolone DIR and imaging coupler combinations of this invention, they were evaluated in the causer/receiver format shown in Table I. The structure of C1 is given after Table I. Other structures in Table I are provided previously or in Example 2. Component laydowns are provided in parenthesis in units of $g/m^2$ in Table I.

DIR couplers A2 and C1 were dispersed at a 1:2 weight ratio in tritolyl phosphate (S-1, mixed isomers). Typically, dispersions are prepared by adding an oil phase containing a 1:2:3 weight ratio of DIR coupler:S-1:ethyl acetate to an aqueous phase containing gelatin and the dispersing agent ALKANOL XC (Dupont) in a 10:1 weight ratio. The mixture is then passed through a colloid mill to disperse the oil phase in the aqueous phase as small particles. The resulting dispersions were 1% by weight of coupler and 6% by weight of gelatin. On coating, the ethyl acetate auxiliary solvent evaporates. Imaging coupler B1 was dispersed with S-1 and addendum ST-1 (see below) at a 1:0.8:0.2 weight ratio with the resulting dispersion being 5% coupler and 8% gelatin by weight. The dispersions were mixed with a silver iodobromide emulsion and additional gelatin and coated as diagrammed in Table I.

Film samples were given a sensitometric white light (neutral) exposure and processed in a standard KODAK FLEXICOLOR C-41 process. Green and red status M densities vs exposure were then measured for film A, containing B1 without DIR coupler, films B and C with B1 and comparative DIR coupler C1 at two levels, and films D and E, containing DIR coupler A2 of this invention at two levels along with imaging coupler B1 of this invention. Lower levels of C1 were coated, since it releases a stronger inhibitor. From the slopes of the density vs exposure plots, gamma values can be calculated. For high interlayer interimage and high color saturation, it is desirable that a DIR coupler provide minimal reduction in gamma in its own layer (so-called causer gamma), but substantial gamma reduction in receiver layers. In this format green gamma corresponds to causer gamma and red gamma to receiver gamma.

Green causer and red receiver gammas for the various films of Table I are listed in Table II. The ratios (Gr/Gg) of red gamma to green gamma are also listed in Table II. It is desirable that when an inhibitor is employed, the ratio of red to green gamma should decrease compared to the case where no inhibitor at all is used. For uninhibited film A with only B1, green and red gammas are 1.27 and 1.10, respectively, and Gr/Gg is 0.87. Thus, in order to have the green layer suppress the red layer more than the green layer, it is desired to employ DIR compounds which result in a ratio less than 0.87. For films B and C, using a comparative DIR coupler C-1, there are desirable reductions in red gamma to 0.93 and 0.83, respectively, but there are also large undesirable reductions in green or causer gamma to 0.84 and 0.68 respectively. The corresponding ratios have undesirably increased to 1.11 and 1.22, respectively. At the levels used in films D and E, inventive DIR coupler A2 provides very similar reductions in red gamma to 0.90 and 0.86, respectively. However, unlike films B and C, there is surprisingly little reduction in causer gamma in films D and E (1.21 and 1.19, respectively). Ratios of 0.74 and 0.72 were thereby obtained. This is exactly what is desired for high interlayer interimage effects. As the data in Table II illustrate, the A2 plus B1 combinations of this invention bring about such desirable reductions in Gr/Gg, whereas the comparative coupler C1 when combined with B1 actually produces undesirable increases in Gr/Gg. These data illustrate that the desired results do not depend on the presence of a particular solvent such as a carbonamide.

TABLE I

| | |
|---|---|
| OVERCOAT: | Gelatin (2.69) |
| | Bis(vinylsulfonyl)methane Hardener (0.227) |
| CAUSER: | B1 (0.43) & S-1 (0.344) & ST-1 (0.086) |
| A) | No DIR Coupler (Uninhibited Check) |
| or B) | C1 (0.0195) & S-1 (0.0390) Comparative |
| or C) | C1 (0.0390) & S-1 (0.0780) Comparative |
| or D) | A2 (0.0704) & S-1 (0.141) Invention |
| or E) | A2 (0.141) & S-1 (0.282) Invention |
| | Green-Sens. Silver Iodobromide T-Grain Emulsion (0.807 Ag) |
| | Gelatin (2.69) |
| INTERLAYER: | IS-1 (0.054) & S-1 (0.054) |
| | Gelatin (0.86) |

TABLE I-continued

| | |
|---|---|
| RECEIVER: | CC-1 (0.753) & S-2 (0.753) (Cyan Dye-Forming Coupler)<br>B-2 (0.054) & S-3 (0.054)<br>IR-5 (0.022) & S-5 (0.044)<br>Red-Sens. Silver Iodobromide T-Grain Emulsion (0.807 Ag)<br>Gelatin (2.69) |
| Cellulose Acetate Support with Gel U-Coat and Antihalation Backing | |

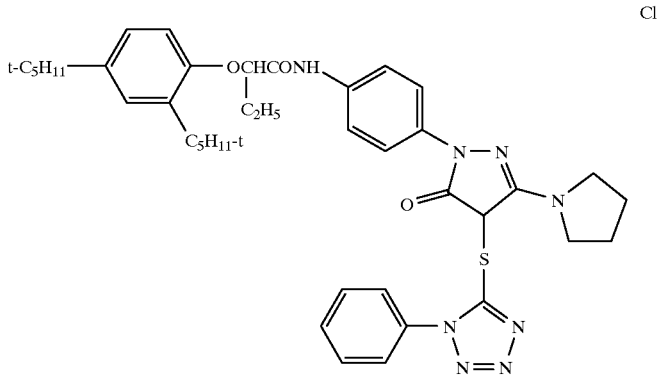

TABLE II

| Film | Green Gamma (Gg) | Red Gamma (Gr) | Gr/Gg |
|---|---|---|---|
| A (Uninhibited) | 1.27 | 1.10 | 0.87 |
| B (Comparative) | 0.84 | 0.93 | 1.11 |
| C Comparative) | 0.68 | 0.83 | 1.22 |
| D (Invention) | 1.21 | 0.90 | 0.74 |
| E (Invention) | 1.19 | 0.86 | 0.72 |

Example 2

Multilayer film structure comprising pyrazolone DIR coupler A2 and imaging coupler B1 of this invention.

The multilayer film structure utilized for this example is shown schematically in Table III. Structures of components not provided previously are given immediately following Table III. Component laydowns are provided in units of g/sq m unless otherwise indicated. Gelatin is used as a binder in the various layers of the multilayer film. This particular composition is coated on polyethylene naphthalate support, containing a magnetic recording layer. This film may be processed using KODAK FLEXICOLOR C-41 chemistry to yield improved interimage and color.

TABLE V

| MULTILAYER FILM STRUCTURE | | |
|---|---|---|
| 1 | Overcoat Layer: | Matte Beads<br>Gelatin (0.89) |
| 2 | UV Protective Layer | UV Absorber UV-1 (0.111) & S-4 (0.111)<br>UV Absorber UV-2 (0.111) & S-4 (0.111)<br>Silver Bromide Lippmann Emulsion (0.215 Ag)<br>Gelatin (0.70) |
| 3 | Fast Yellow Layer | Y-1 (0.150) Yellow Dye-Fonning Coupler &<br>S-1 (0.075)<br>IR-1 (0.032) DIR Coupler & S-1 (0.016)<br>B-1 (0.0054) & S-3 (0.0070)<br>Blue Sensitive Silver Iodobromide Emulsion (0.430 Ag),<br>4.5 mole % Iodide Tabular-Grain (2.3 × 0.13 μm)<br>Gelatin (0.753) |
| 4 | Slow Yellow Layer: | Y-1 (0.915) & S-1 (0.457)<br>IR-1 (0.032) & S-1 (0.016)<br>B-1 (0.0065) & S-3 (0.0084)<br>Blue Sensitive Silver Iodobromide Emulsion (0.180 Ag),<br>4.5 mole % Iodide Tabular-Grain (1.4 × 0.13 μm)<br>Blue Sensitive Silver Iodobromide Emulsion (0.120 Ag),<br>1.5 mole % Iodide Tabular-Grain (0.85 × 0.13 μm)<br>Blue Sensitive Silver Iodobromide Emulsion (0.180 Ag)<br>1.3 mole % Iodide Tabular-Grain (0.54 × 0.09 μm)<br>Gelatin (1.668)<br>Bis(vinylsulfonyl)methane Hardener at 2.1%<br>by weight of total Gelatin |

TABLE V-continued

| MULTILAYER FILM STRUCTURE | |
|---|---|
| 5 Yellow Filter Layer: | R-1 (0.075) & S-2 (0.121) & ST-2 (0.010)<br>Gelatin (0.861)<br>YD-2 Filter Dye (0.108) |
| 6 Fast Magenta Layer | B1 (0.050) Magenta Dye-Forming Coupler &<br>S-1 (0.045) & ST-1 (0.005) Addendum<br>MM-1 (0.020) Masking Coupler & S-1 (0.040)<br>A2 (0.030) DIR Coupler & S-1 (0.060) |
| Green Sensitive Silver Iodobromide Emulsion (0.699 Ag), | 4.5 mole % Iodide Tabular-Grain (0.98 × 0.11 μm)<br>Gelatin (1.12) |
| 7 Mid Magenta Layer: | B1 (0.090) & S-1 (0.081) & ST-1 (0.009)<br>MM-1 (0.025) & S-1 (0.050)<br>A2 (0.032) DIR Coupler & S-1 (0.064) |
| Green Sensitive Silver Iodobromide Emulsion (0.646 Ag), | 4.5 mole % Iodide Tabular-Grain (0.61 × 0.12 μm)<br>Gelatin (1.41) |
| 8 Slow Magenta Layer: | B1 (0.200) & S-1 (0.180) & ST-1 (0.020)<br>MM-1 (0.035) & S-1 (0.070) |
| Green Sensitive Silver Iodobromide Emulsion (0.258 Ag), | 1.5 mole % Iodide Tabular-Grain (0.70 × 0.11 μm) |
| Green Sensitive Silver Iodobromide Emulsion (0.409 Ag), | 1.3 mole % Iodide Tabular-Grain (0.54 × 0.09 μm)<br>Gelatin (1.18) |
| 9 Interlayer: | R-1 (0.075) Interlayer Scavenger & S-6 (0.113)<br>Gelatin (0.86) |
| 10 Fast Cyan Layer | CC-1 (0.161) Cyan Dye-Forming Coupler & S-2 (0.161)<br>CM-1 (0.032) Masking Coupler<br>IR-3 (0.038) DIAR Coupler & S-5 (0.038)<br>IR-4 (0.038) DIAR Coupler & S-2 (0.076) |
| Red Sensitive Silver Iodobromide Emulsion (1.08 Ag), | 4.5 mole % Iodide Tabular-Grain (1.10 × 0.11 μm)<br>Gelatin(1.45) |
| 11 MidCyan Layer: | CC-1 (0.183) & S-2 (0.183)<br>CM-1 (0.011)<br>B-1 (0.027) & S-3 (0.035)<br>IR-3 (0.054) & S-5 (0.054) |
| Red Sensitive Silver Iodobromide Emulsion (0.215 Ag), | 4.5 mole % Iodide Tabular-Grain (0.98 × 0.11 μm) |
| Red Sensitive Silver Iodobromide Emulsion (0.861 Ag), | 3.3 mole % Iodide Cubic (0.49 μm)<br>Gelatin(1.35) |
| 12 Slow Cyan Layer: | CC-1 (0.355) & S-2 (0.355)<br>IR-4 (0.011) & S-2 (0.022)<br>B-1 (0.075) & S-3 (0.098) |
| Red Sensitive Silver Iodobromide Emulsion (0.387 Ag), | 3.3 mole % Iodide Cubic (0.32 μm)<br>Gelatin (1.64) |
| 13 Interlayer: | R-1 (0.075) & S-6 (0.113)<br>Gelatin (0.86) |
| 14 Antihalation Layer | Grey Silver (0.15 Ag), CD-1 (0.0075); MD-1 (0.032)<br>S-1, S-6 (0.323), Gelatin (1.61)<br>YD-1 (0.039) & S-1 (0.078) |

Polyethylene Naphthalate Support with Magnetic Recording Layer

S-1

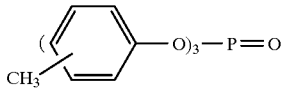

mixed isomers

S-2

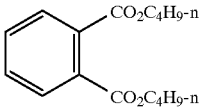

S-3

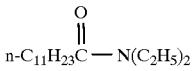

TABLE V-continued
| MULTILAYER FILM STRUCTURE | |
|---|---|
| 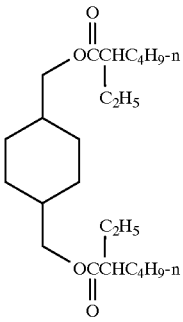 | S-4 |
| 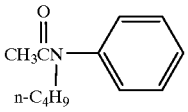 | S-5 |
| 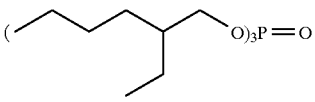 | S-6 |
| 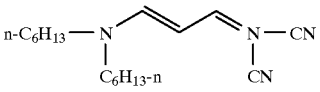 | UV-1 |
| 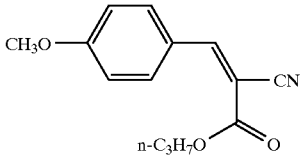 | UV-2 |
| 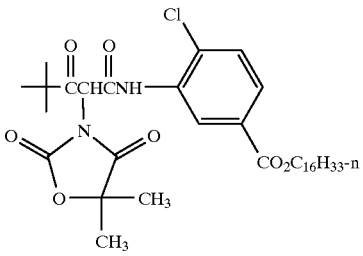 | Y-1 |
| 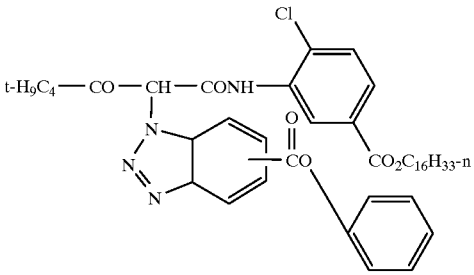 | IR-1 |

TABLE V-continued
| MULTILAYER FILM STRUCTURE | |
|---|---|
| 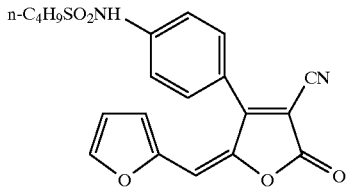 | YD-2 |
| 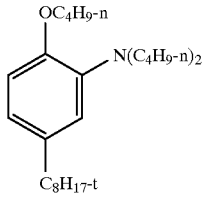 | ST-1 |
| 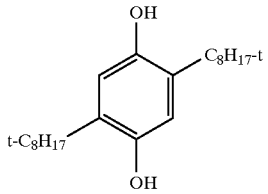 | R-1 |
| 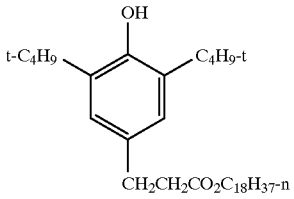 | ST-2 |
| 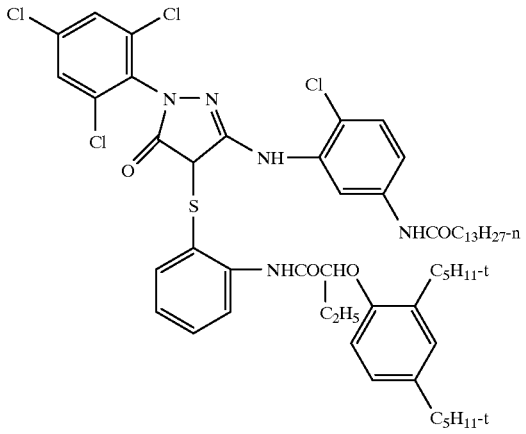 | B-1 |

TABLE V-continued
| MULTILAYER FILM STRUCTURE | |
|---|---|
| 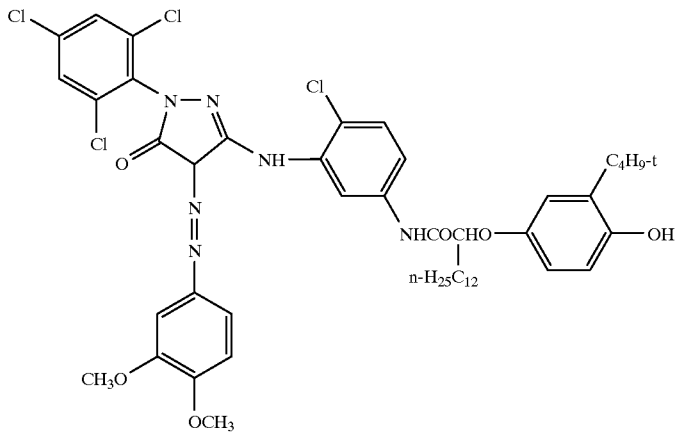 | MM-1 |
| 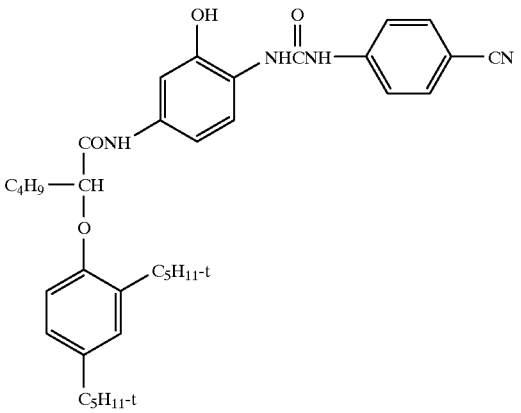 | CC-1 |
| 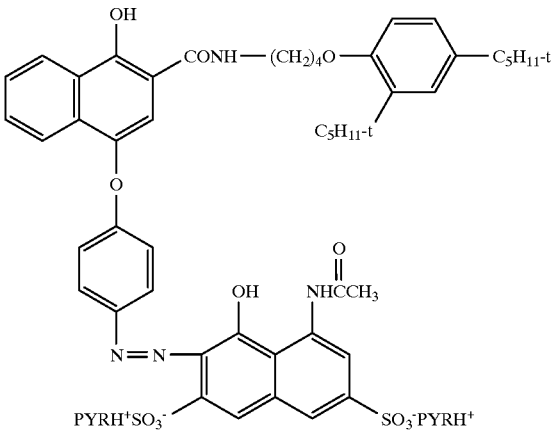 | CM-1 |
| 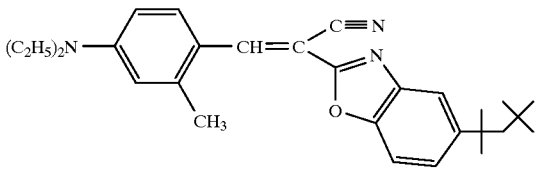 | YD-1 |

TABLE V-continued
| MULTILAYER FILM STRUCTURE | |
|---|---|
| 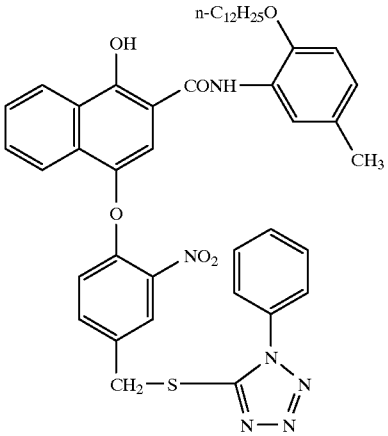 | IR-3 |
| 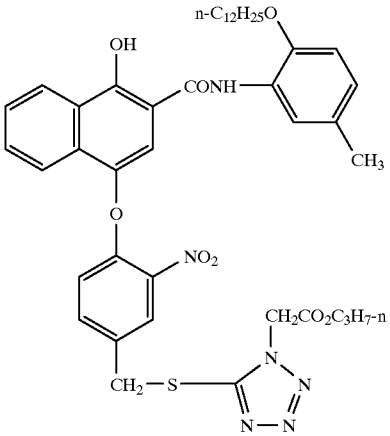 | IR-4 |
| 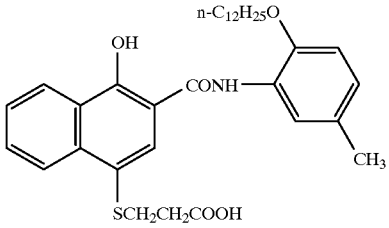 | B-1 |
| 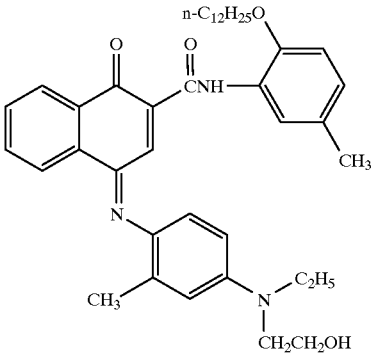 | CD-1 |

TABLE V-continued

| MULTILAYER FILM STRUCTURE |
|---|
| MD-1 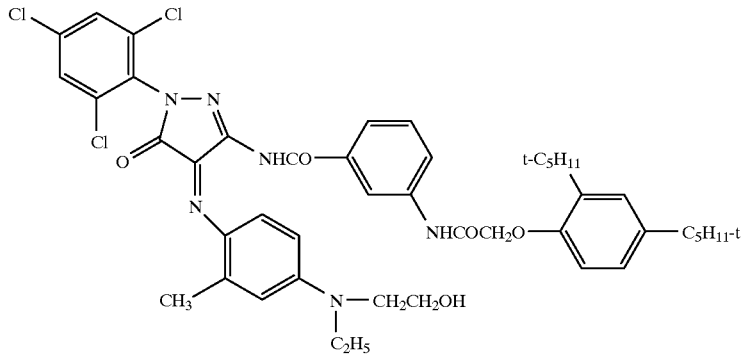 |

What is claimed is:

1. A photographic element comprising a silver halide emulsion layer sensitive to green light having associated therewith (a) a 1-aryl-3-anilino-4-benzotriazolyl-5-pyrazolone magenta dye-forming DIR coupler of formula I, and (b) a 1-aryl-3-anilino-4-phenylthio-5-pyrazolone magenta image dye forming coupler of formula II:

I

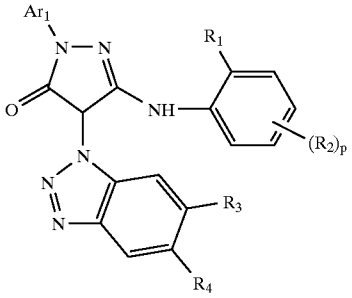

wherein:

$Ar_1$ is an unsubstituted aryl group or an aryl group with one or more substituents individually selected from the group consisting of halogen atoms and alkyl, phenyl, alkoxy, aryloxy, carbonamido, carbamoyl, acyloxy, alkoxycarbonyl, aryloxycarbonyl, sulfonamido, sulfamoyl, sulfonyl, sulfoxyl, sulfonyloxy, and cyano groups;

$R_1$ is a hydrogen or halogen atom or an alkyl or alkoxy group;

each $R_2$ may be in the para position or either meta position relative to the NH group and is individually selected from the group consisting of halogen atoms and alkyl, phenyl, alkoxy, phenoxy, carbonamido, carbamoyl, acyloxy, alkoxycarbonyl, aryloxycarbonyl, sulfonamido, alkylsulfonyl, arylsulfonyl, sulfoxyl, sulfonyloxy, sulfamoyl, alkylthio, arylthio, cyano, and imido groups, and p is 0, 1 or 2;

$R_3$ and $R_4$ are individually selected from hydrogen and halogen atoms, and from alkyl, phenyl, alkoxy, phenoxy, alkoxycarbonyl, aryloxycarbonyl, carbonamido (including alkyl-, aryl-, alkoxy- and aryloxycarbonamido), sulfonamido, carbamoyl and carbamoyloxy groups;

provided that at least one of $R_3$ and $R_4$ is other than hydrogen;

II

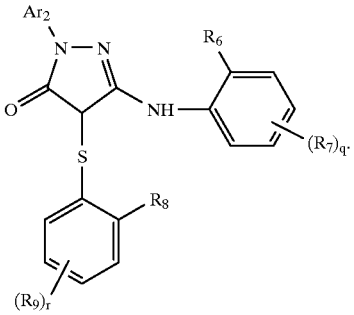

wherein:

$Ar_2$ is an unsubstituted aryl group or an aryl group with one or more substituents individually selected from the group consisting of halogen atoms and alkyl, phenyl, alkoxy, aryloxy, carbonamido, carbamoyl, acyloxy, alkoxycarbonyl, aryloxycarbonyl, sulfonamido, sulfamoyl, sulfonyl, sulfoxyl, sulfonyloxy, and cyano groups;

$R_6$ is a hydrogen or halogen atom or an alkyl or alkoxy group;

each $R_7$ may be in the para position or either meta position relative to the NH group and is individually selected from the group consisting of halogen atoms and alkyl, phenyl, alkoxy, phenoxy, carbonamido, carbamoyl, acyloxy, alkoxycarbonyl, aryloxycarbonyl, sulfonamido, alkylsulfonyl, arylsulfonyl, sulfoxyl, sulfonyloxy, sulfamoyl, alkylthio, arylthio, cyano, and imido groups, and q is 0, 1 or 2;

$R_8$ and $R_9$ are individually selected from the group consisting of hydrogen and halogen atoms and alkyl, alkoxy, phenoxy, carbonamido, carbamoyl, sulfonamido, sulfamoyl, alkylsulfonyl, arylsulfonyl, alkoxycarbonyl, aryloxycarbonyl, acyloxy, sulfoxyl, and sulfonyloxy groups, and r is 0, 1 or 2;

$R_9$ is in the para position or either meta position relative to the sulfur atom; and the total number of carbon atoms in $R_8$ and $R_9$ taken together is at least 4.

2. A photographic element according to claim 1, wherein $Ar_1$ is a phenyl group.

3. A photographic element according to claim 1, wherein $R_1$ is a halogen atom or an alkoxy group.

4. A photographic element according to claim 1, wherein p is one and $R_2$ is an electron-withdrawing substituent in the para position relative to either the NH group or $R_1$.

5. A photographic element according to claim 1, wherein q is one and $R_7$ is an electron-withdrawing substituent in the para position relative to either the NH group or $R_6$.

6. A photographic element according to claim 1, wherein the sum of the pi values of $R_3$ and $R_4$ taken together is from 0.50 to 3.00.

7. A photographic element according to claim 1, wherein at least one of $R_3$ and $R_4$ is a readily hydrolyzable group.

8. A photographic element according to claim 7, wherein at least one of $R_3$ and $R_4$ is a phenoxycarbonyl group or a —$CO_2CH_2CO_2R_5$ group, wherein $R_5$ is an alkyl or phenyl group.

9. A photographic element according to claim 1 wherein $Ar_1$ is a phenyl ring with at least on unsubstituted carbon in a position ortho to the pyrazolone nitrogen.

10. A photographic element according to claim 9 wherein p is one and $R_2$ is a substituent in the para position relative to either the NH group or $R_1$.

11. A photographic element according to claim 1 wherein the total number of carbon atoms on $R_8$ and $R_9$ taken together is at least 5.

12. A photographic element according to claim 1 wherein $R_8$ is an amido or alkyl group.

13. A photographic element according to claim 1 wherein $R_6$ is a chloro group.

14. A photographic element according to claim 1 wherein $Ar_1$ contains from 1 to 3 chloro groups.

15. A photographic element according to claim 1 wherein the level of DIR coupler I is between 0.005 and 0.40 g/sq m.

16. A photographic element according to claim 1, wherein the coated level of pyrazolone coupler II is between 0.02 and 2.00 g/sq m.

17. A photographic element according to claim 1, wherein coupler I is selected from the group consisting of A2, A3, A5, A8, A14, A15, A21 and A24:

A2

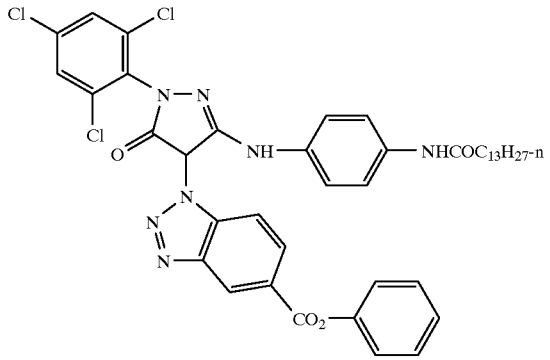

-continued

A3

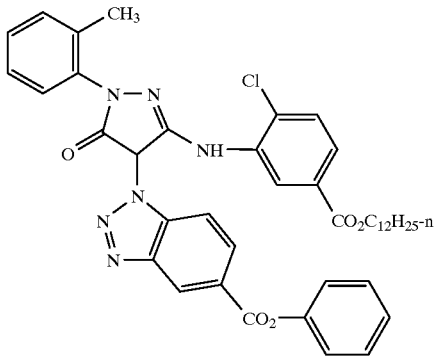

A5

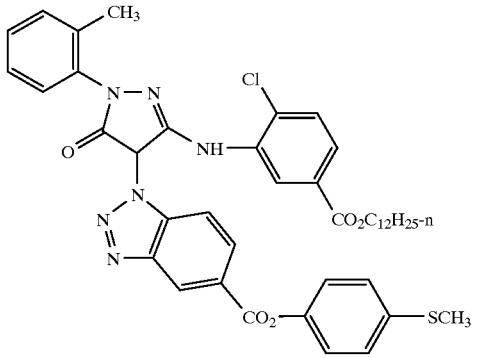

A8

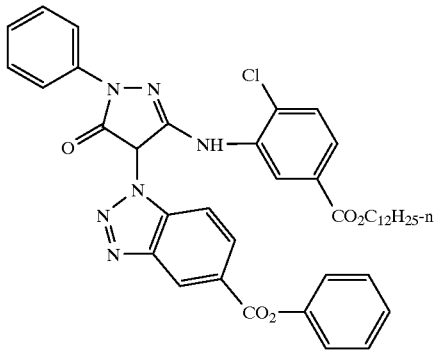

A14

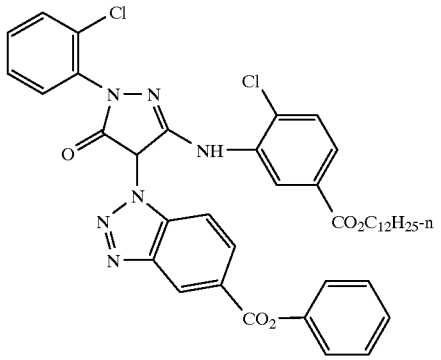

-continued
A15
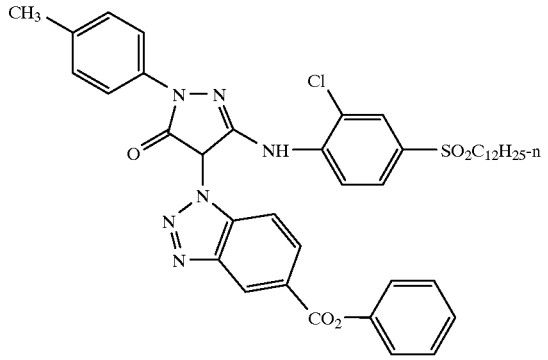
A21
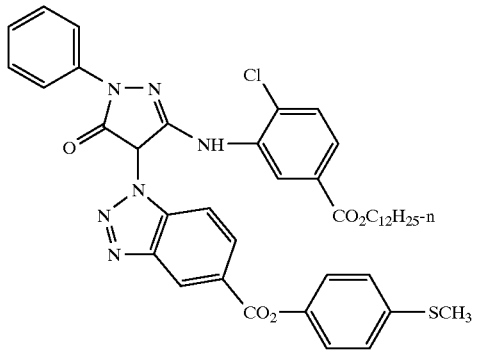
and
A24
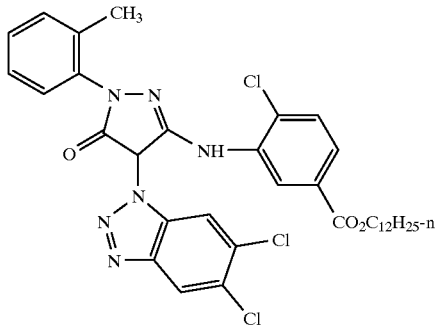
18. A photographic element according to claim 1, wherein coupler II is selected from the group consisting of:
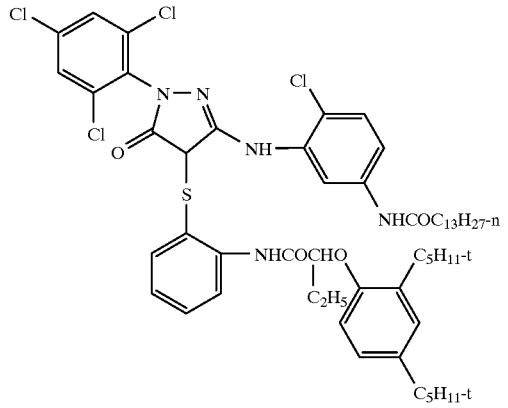
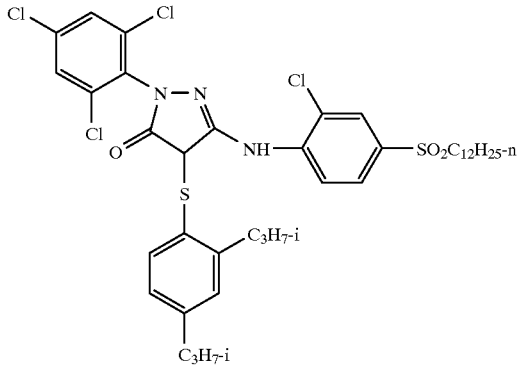
and
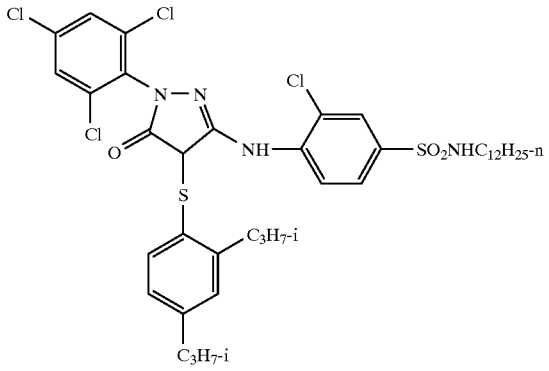
19. A photographic element according to claim 1, comprising a transparent magnetic recording layer.
20. A photographic element according to claim 1 having appended thereto a lens.
* * * * *